United States Patent [19]

VanderLinden, Jr. et al.

[11] 4,086,599

[45] Apr. 25, 1978

[54] DISH ANTENNA WITH ADJUSTABLE AND COLLAPSIBLE SUPPORT

[75] Inventors: Paul Guisbert VanderLinden, Jr.; James Elwyn Crutcher, both of Kilgore, Tex.

[73] Assignee: Radio Mechanical Structures, Inc., Kilgore, Tex.

[21] Appl. No.: 678,048

[22] Filed: Apr. 19, 1976

[51] Int. Cl.[2] ..... H01Q 1/08

[52] U.S. Cl. ..... 343/881; 343/882

[58] Field of Search ..... 343/765, 766, 912, 915, 343/880, 881, 882

[56] References Cited

U.S. PATENT DOCUMENTS

| | | | |
|---|---|---|---|
| 3,787,870 | 1/1974 | Rocci | 343/765 |
| 3,940,771 | 2/1976 | Wild | 343/766 |
| 3,945,015 | 3/1976 | Gueguen | 343/912 |

FOREIGN PATENT DOCUMENTS

| | | | |
|---|---|---|---|
| 2,215,977 | 2/1972 | Germany | 343/912 |
| 884,894 | 12/1961 | United Kingdom | 343/915 |

*Primary Examiner*—Eli Lieberman

[57] ABSTRACT

A composite antenna arrangement is secured to a foundation, or pad, via a multi-element force absorbing truss-like pedestal. The pedestal provides elevation and azimuth rotational axes for selecting and adjusting the reflector pointing orientation, and permits job site reflector installation without requiring a lifting crane or the like.

2 Claims, 8 Drawing Figures

DISH ANTENNA WITH ADJUSTABLE AND COLLAPSIBLE SUPPORT

DISCLOSURE OF THE INVENTION

This invention relates to electrical antennas and, more specifically, to an improved antenna and pedestal frame assembly, and method of job site antenna erection employing such assembly.

It is an object of the present invention to provide an improved antenna organization.

More specifically, it is an object of the instant invention to provide an antenna arrangement (i) which includes a reliable and readily fabricated reflector mounting pedestal assembly; (ii) which provides secure reflector pointing variable through a relatively wide range of azimuth and elevation orientations; (iii) which is resistant to relatively large ambient wind and other forces; and (iv) which may be erected on site without requiring heavy lifting equipment such as a crane or the like for reflector installation.

The above and other objects and features of the present invention are realized in a specific, illustrative composite antenna arrangement having a parabolic reflector arrangement secured to a foundation, or pad, via a multielement force absorbing truss-like pedestal. The pedestal provides elevation and azimuth rotational axes to vary the reflector pointing direction, and also permits installation of the reflector with a single cable tensioning element, e.g., a winch, without requiring a job site reflector-lifting and supporting crane or the like.

The above and other features and advantages of the present invention will become more clear from the following detailed description of an illustrative embodiment thereof, presented hereinbelow in conjunction with the accompanying drawing, in which.

Figure 1:
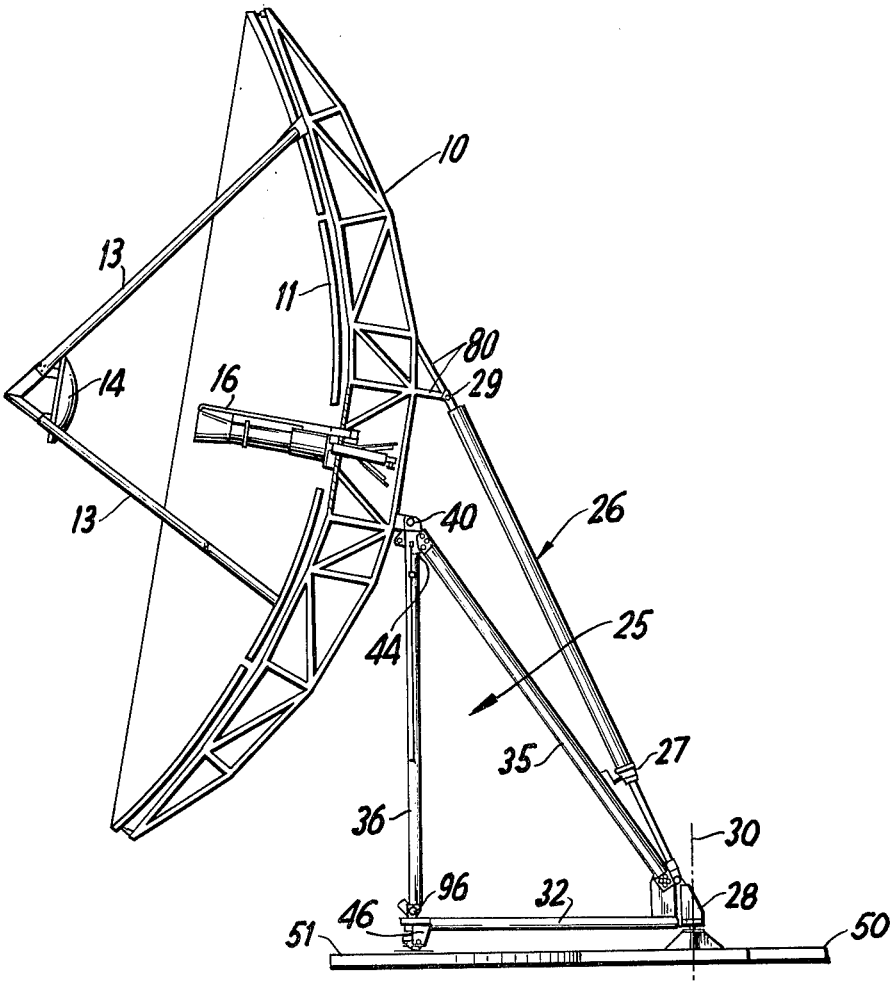
FIG. 1 is a full side elevation.
Figure 2:
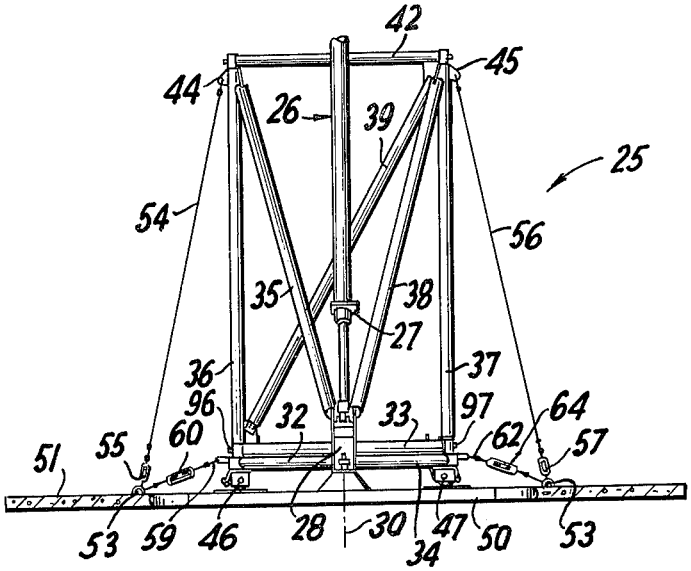
FIGS. 2 and 3 are partial rear and top views of a fully assembled and installed composite antenna assembly embodying the principles of the present invention.
Figure 3:
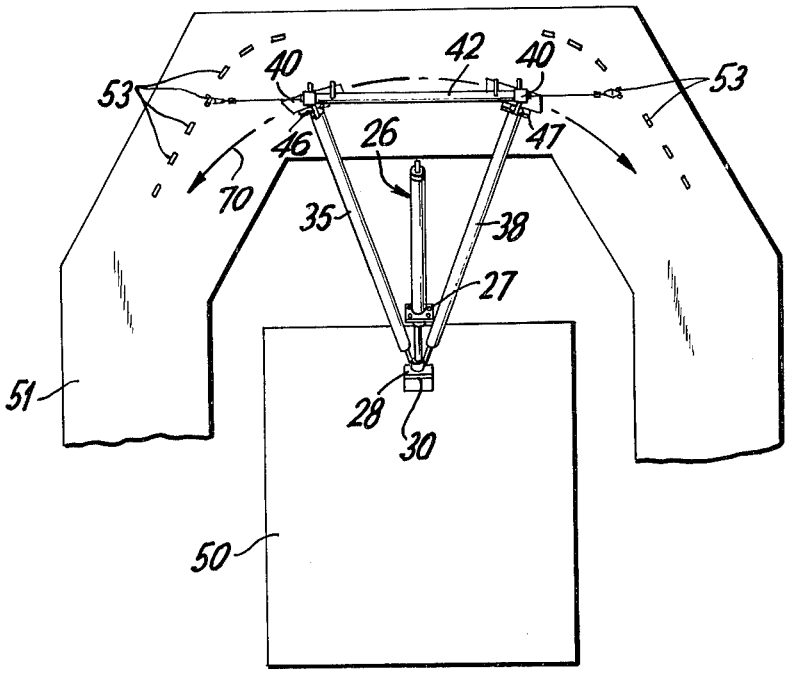
Figure 5:
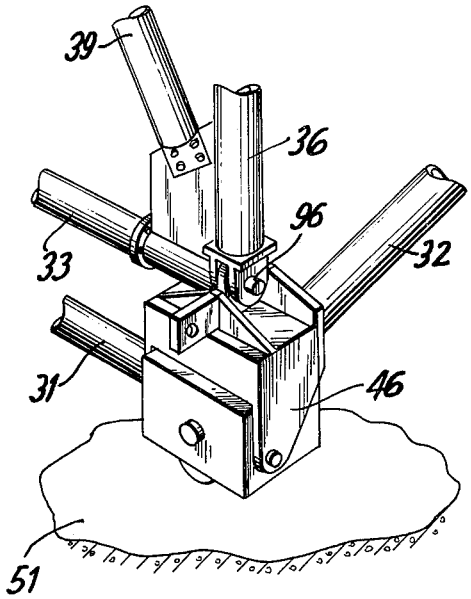
Figure 4:
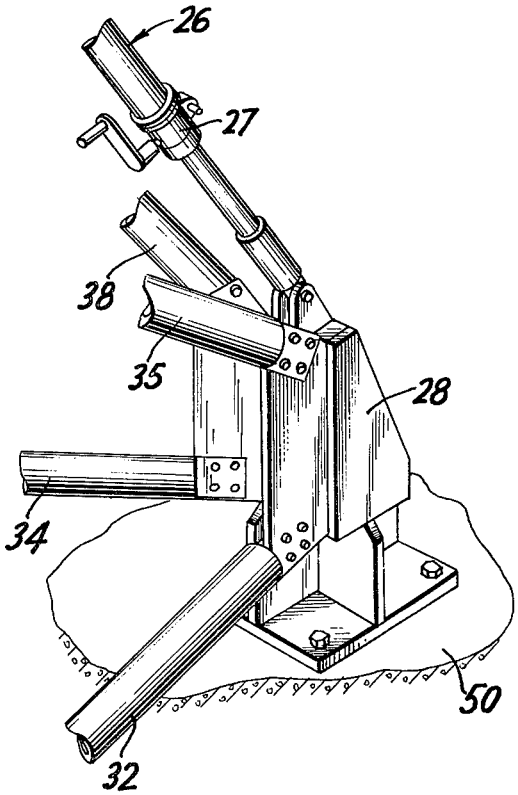
Figure 6:
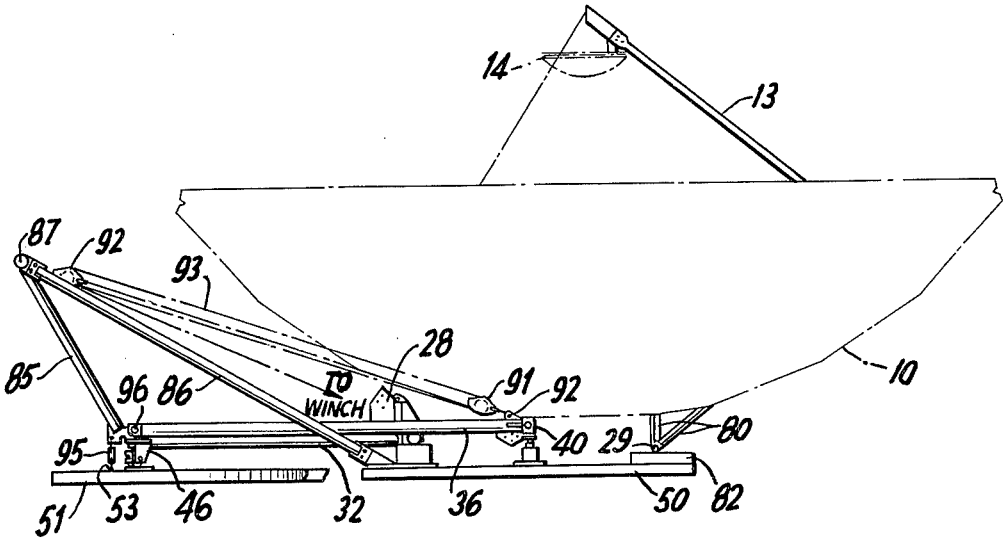
Figure 7:
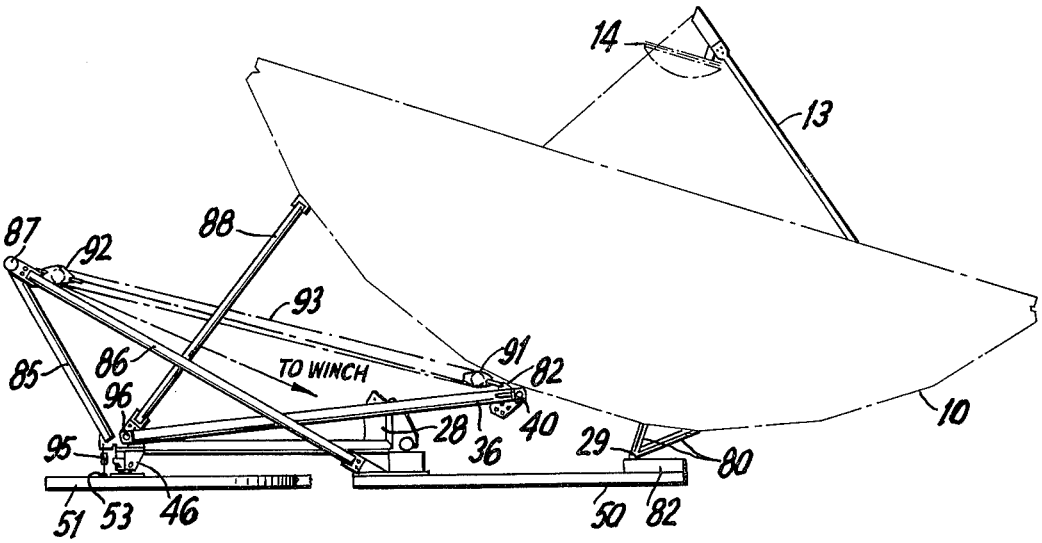
Figure 8:
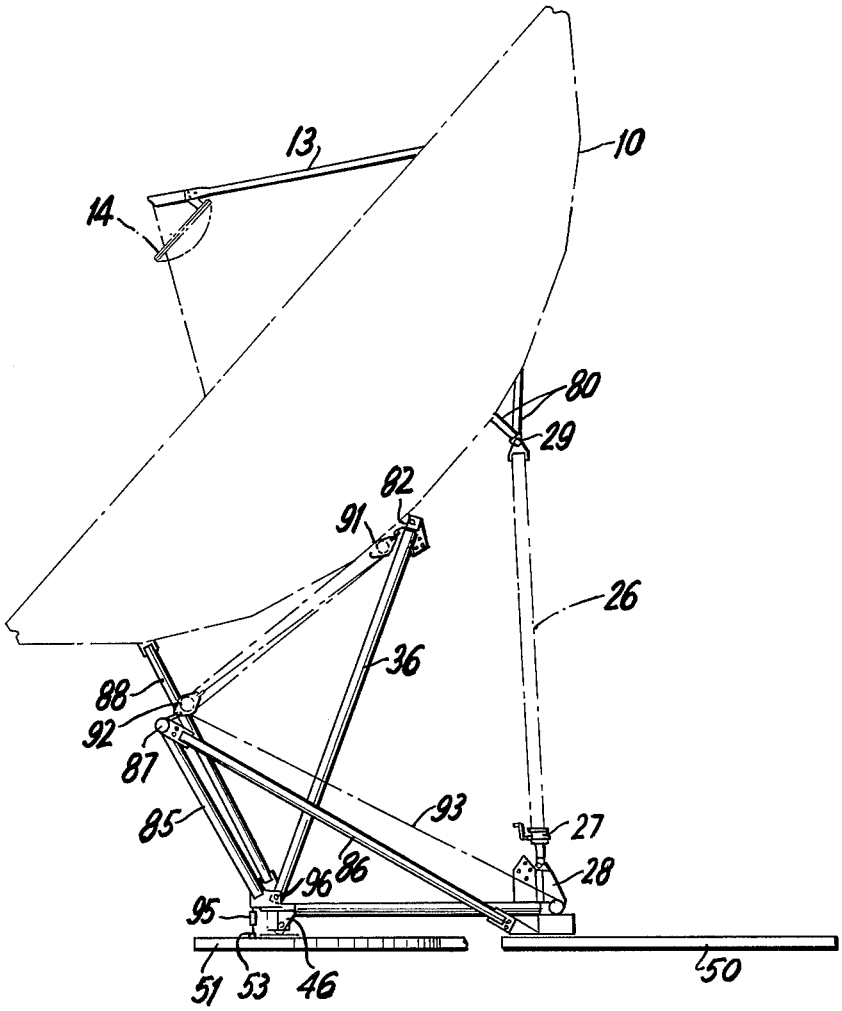

FIGS. 4 and 5 depict junction elements 46 and 28 (illustrative of such elements 28 and 44–47) in FIGS. 1–3; and FIGS. 6 through 8 are side views illustrating the process of installing an antenna into the posture illustrated in FIG. 1, FIGS. 6 through 8 respectively being directed to progressively advanced states of antenna erection.

Referring now to FIGS. 1 through 5, there is shown an installed, operational antenna assembly which includes composite reflector 10, e.g., of parabolic form, having an inner active radio frequency energy reflecting surface 11. In an energy emitting, transmission mode, a central feed 16 directs radio frequency or microwave energy at a sub-reflector 14 supported from the main reflector 10 by spaced tripod legs 13. Energy passes from the surface of the sub-reflector 14 to the main reflector surface 11 from which it radiates along the intended, pointing direction of the surface 11. An inverse energy flow obtains for a signal receiving antenna mode.

The particular pointing direction of the antenna reflector 10–11 is defined by the reflector orientation about an elevation axis 40 horizontally disposed with respect to the rear of the reflector 10, and also the attitude about a vertical azimuth axis 30 disposed where a mechanical plural element junction and bearing member 28 is attached to a horizontal antenna foundation, or pad portion 50. Thus, the pointing elevation of the reflector surface 11 may be increased or decreased by a clockwise or counter-clockwise rotation of the reflector 10 about the elevation axis 40 (in the left plan view of FIG. 1), and a change in azimuth for the reflector 11 is effected by rotating the entire antenna assembly about the azimuth axis 30.

The composite antenna assembly is secured to two horizontal foundation or pad areas 50 and 51, e.g., formed of concrete, which may, of course, be integrally formed as a single unit. At the rear of the reflector 10, the horizontal elevation axis is defined by two mechanical junction brackets 44 and 45 pivotably affixed to the reflector 10, and an elevation implementing (actuating) pivot point 29 defined by mechanical frame member 80 secured to the reflector. Also included in the pedestal assembly of FIGS. 1 through 5 are two spaced bottom junction members 46 and 47 which include rollers to translate along a circular arc 70 on the pad 51. The arc 70 is of a fixed radius with respect to the azimuth axis 30 at junction-bearing 28 secured to the pad portion 50.

A fixed form, rotating, plural element truss 25 interconnects the junction members 44, 45, 46 and 47. The truss includes a rectangular-like structure defined by elements 42, 36, 37 and 33 connecting the elevation axis 40 with the front junction-rollers 46 and 47. The junction members 46 and 47, and the elevation axis junctions 44 and 45, are respectively connected to the azimuth axis junction/bearing 28 by truss elements 31, 32, 34, 35 and 38, and a force absorbing element 39 joins junction connectors 45 and 46. Each of the junction elements 44, 45, 46, 47, and 28 provides rigid, defined angular relationships for each of the truss members secured thereto, e.g., via bolts and bolt-receiving apertures which cooperates with bolt-passing apertures on flanges of the truss elements 42, 36, 37, 33, 31, 32, 34, 35, 38 and 39.

An elevation jack assembly 26 pivotably connects the azimuth axis bearing/junction 28 with the pivot point 29 on frame members 80 at the rear of the reflector 10. The elevation jack assembly is of variable length, e.g., depending upon the mechanical adjustment of a crank assembly.

It will thus be appreciated that the elevation angle for the reflector surface 11 depends upon the particular length of the jack assembly 26, and that the azimuth for the composite antenna is defined by the particular disposition of the rolling junction members 46 and 47.

To fix the antenna at any desired azimuth, cabling 54, 59, and 56, 62 connects the respective truss junctions 44–47 to two of a series of eyebolts 53 secured to the pad portion 51. Thus, for example, the eyebolts 53 may be disposed in the pad 51 at a radius (relative to azimuth axis 30) greater or less than that of the arc 70 to not interfere with movement of the rollers 46 and 47 while providing convenient eyebolt locations for any particular azimuth disposition for the antenna. The cabling lengths 54, 59, 56 and 62 may advantageously include turnbuckles 55, 60, 57, and 64 to properly tension the truss azimuth orientation, and to make fine corrections thereto as required.

It is also observed that the truss structure described hereinabove fixedly and rigidly connects the reflector 10–11 to the foundation 50–51 and maintains the pointing direction of the reflector surface 11, notwithstanding perturbations and ambient forces, such as wind, ground tremors or the like which are simply absorbed in the overall truss 25 assembly.

Referring now to FIGS. 6 through 8, there is presented progressive orientations of the composite antenna structure during an installation process from an initial state (FIG. 6) to the final, installed condition of FIG. 1. As seen in FIG. 6, the reflector 10 begins by simply having the frame members 80 and pivot point 29 rest on a block 82 on the concrete pad 50, and with the front rectangular-like pedestal frame members 36, 33, 37, 39 and 42, and the bottom triangularly disposed members 31, 32 and 34 in place. At this point in antenna erection, the elevation jack assembly 26 is not yet employed, nor are the truss members 35 and 38. Each of these eventually, of course, are required to provide an operative reflector supporting truss structure.

For installation purposes only (and removed prior to antenna operation as below discussed), additional, temporary structural elements 85 and 86, joined at a fixed angular relationship by junctor 87, are fixed to the rolling junction member 46 which, in turn, is secured by a cable and turnbuckle restraint 95 to a convenient eyebolt 53 to prevent movement thereof. Apparatus identical to the structure 85, 86, 87, and 95 obtains to connect the truss connectors 28 and 47. For conciseness of description, only the elements visible from the left side view shown in FIGS. 6 through 8 will be hereafter described, it being appreciated that the symmetrically disposed additional members perform in an identical manner during antenna installation.

Pulleys 91 and 92 are secured to the permanent truss junction element 40 (as via an aperture in a projection 82 thereon) and the temporary connector 87, and a cable 93 passes between the pulleys 91 and 92. The cable 93 is taken up during antenna reflector 10 installation by a tensioning member not shown, e.g., a simple winch secured to the pad 50.

The apparatus above described in conjunction with FIG. 6 operates by gathering (e.g., reeling) in the cable 93. This shortening of the cable 93 causes the reflector 10 to rotate clockwise about the pivot point 29 (which also moves slightly to the left), to progress from the orientation of FIG. 6 to that of FIG. 7.

Having attained the FIG. 7 positioning, temporary reflector support struts 88 are fixedly attached between the projecting gussets welded to member 33, and the rear of the reflector 10. After the reflector support struts 88 are installed, further cabling 93 is taken up to rotate the reflector 10 about an effective pivoting axis 96–97 (see FIGS. 1, 2 or 5) until the orientation of FIG. 8 is reached.

Once the FIG. 8 disposition is achieved, the elevations jack assembly 26 is installed between the junction/bearing element 28 and the pivot 29. The reflector is further rotated counter-clockwise by elongation of the elevation jack assembly 26 until the truss members 36 and 37 reach a vertical plane. At this point, the remaining truss elements 35 and 38 are secured as by bolting between the junctions 44 and 28, and 45 and 28, respectively, such that the fully stable truss assembly 25 is securely in place and operational. Following this, the temporary installation elements 85, 86, 87, 88, 91, 92 and 93 are no longer required and are removed; the turnbuckle restraints 95 are similarly removed; and the antenna is set to its desired position as above described and is ready for use.

Thus, the above described apparatus and methodology functions to erect the composite antenna on the actual job site platform 50–51 without requiring the use of expensive and sometimes unavailable lifting equipment to support the reflector 10 and its related structure while a pedestal is constructed under it. This is extremely important since antennas of the subject class, typically involving line-of-sight radio wave propogation, may be constructed on relatively unaccessable hilltops and the like where access would be difficult or impossible, and certainly expensive, to transport a crane or similar lifting element.

Also, once constructed, the antenna and truss platform provide a secure, reliable reflecting surface supporting apparatus which, moreover, may be readily varied as to orientation. The above described arrangement is merely illustrative of the principles of the present invention. Numerous modifications and adaptations thereof will be readily apparent to those skilled in the art without departing from the spirit and scope of the present invention.

What is claimed is:

1. In combination in an antenna, a reflector having first and second horizontally spaced junction means at its rear surface defining an antenna elevation axis therebetween and elevation implementing pivot means vertically spaced from said elevation axis, fixed azimuth axis defining bearing and junction means, first and second translating junction means, multi-element rigid truss means interconnecting said first and second horizontally spaced junction means, said first and second translating junction means and said azimuth axis defining bearing and junction means, and means connecting said azimuth bearing and junction means with said elevation axis implementing pivot means, further comprising foundation means having said first azimuth axis defining bearing and junction means affixed thereto and which is in relative translation contact with said first and second translating junction means, said first and second translating junction means having a fixed radius with respect to said bearing and junction means, a plurality of spaced attaching point means affixed to said foundation means at a radius different than the radius between said first and second translating junction means and said bearing and junction means, and cable means attaching said truss means to at least two of said attaching point means.

2. A combination as in claim 1 further comprising turnbuckle means included in said cable means.

* * * * *